US005367811A

United States Patent [19]

Sansom

[11] Patent Number: 5,367,811

[45] Date of Patent: Nov. 29, 1994

[54] TRIGGER LOCK DEVICE

[76] Inventor: Kenneth C. Sansom, 232 Wilson Cir., Thorsby, Ala. 35171

[21] Appl. No.: 123,801

[22] Filed: Sep. 20, 1993

[51] Int. Cl.[5] ..... F41A 17/54

[52] U.S. Cl. ..... 42/70.07; 42/70.11

[58] Field of Search ..... 42/70.07, 70.06, 70.11

[56] References Cited

U.S. PATENT DOCUMENTS

| | | | |
|---|---|---|---|
| 2,444,649 | 7/1948 | Jacobs | 42/70.07 |
| 3,732,641 | 5/1973 | Adajian | 42/70.07 |
| 4,030,221 | 6/1977 | Doobenen et al. | 42/70.07 |
| 4,852,286 | 8/1989 | Troncoso et al. | 42/70.07 |
| 4,934,083 | 6/1990 | Smith | 42/70.07 |
| 5,024,017 | 6/1991 | Nishioka | 42/70.07 |
| 5,033,218 | 7/1991 | Nelson | 42/70.07 |
| 5,050,328 | 9/1991 | Insko | 42/70.07 |
| 5,054,222 | 10/1991 | Hardy | 42/70.07 |
| 5,283,971 | 2/1994 | Fuller et al. | 42/70.06 |
| 5,309,661 | 5/1994 | Fuller et al. | 42/70.07 |

*Primary Examiner*—David Brown
*Attorney, Agent, or Firm*—E. Michael Combs

[57] ABSTRACT

A lock assembly is arranged for positioning between a firearm trigger and the firearm frame within the trigger guard, such that the lock housing is arranged to indicate a false key lock through the bottom wall thereof, but is arranged for ease of accessibility to the firearm by pivotal displacement of the first side wall having a projecting latch arranged for engaging a recess within the locking loop directed through the top wall of the lock housing.

4 Claims, 4 Drawing Sheets

TRIGGER LOCK DEVICE

BACKGROUND OF THE INVENTION

1. Field of the Invention

The field of invention relates to firearm lock structure, and more particularly pertains to a new and improved trigger lock device wherein the same is arranged for ease of mounting relative to an associated firearm preventing access to the firearm by children and the like.

2. Description of the Prior Art

Lock structure of various types have been utilized in the prior art and exemplified by the U.S. Pat. Nos. 4,934,083; 5,033,218; 4,030,221; 5,050,328; and 4,852,286.

The instant invention attempts to overcome deficiencies of the prior art by providing for a firearm locking device wherein the same is arranged to discourage access to the firearm by children and the like by providing for ease of access to the firearm by adults comprehending the ease of disengaging the lock structure and in this respect, the present invention substantially fulfills this need.

SUMMARY OF THE INVENTION

In view of the foregoing disadvantages inherent in the known types of firearm locking structure now present in the prior art, the present invention provides a trigger lock device wherein the same is arranged to prevent operation of a trigger relative to an associated firearm. As such, the general purpose of the present invention, which will be described subsequently in greater detail, is to provide a new and improved trigger lock device which has all the advantages of the prior art firearm locking structure and none of the disadvantages.

To attain this, the present invention provides a lock assembly arranged for positioning between a firearm trigger and the firearm frame within the trigger guard, such that the lock housing is arranged to indicate a false key lock through the bottom wall thereof, but is arranged for ease of accessibility to the firearm by pivotal displacement of the first side wall having a projecting latch arranged for engaging a recess within the locking loop directed through the top wall of the lock housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved trigger lock device which has all the advantages of the prior art firearm lock structure and none of the disadvantages.

It is another object of the present invention to provide a new and improved trigger lock device which may be easily and efficiently manufactured and marketed.

It is a further object of the present invention to provide a new and improved trigger lock device which is of a durable and reliable construction.

An even further object of the present invention is to provide a new and improved trigger lock device which is susceptible of a low cost of manufacture with regard to both materials and labor, and which accordingly is then susceptible of low prices of sale to the consuming public, thereby making such trigger lock devices economically available to the buying public.

Still yet another object of the present invention is to provide a new and improved trigger lock device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
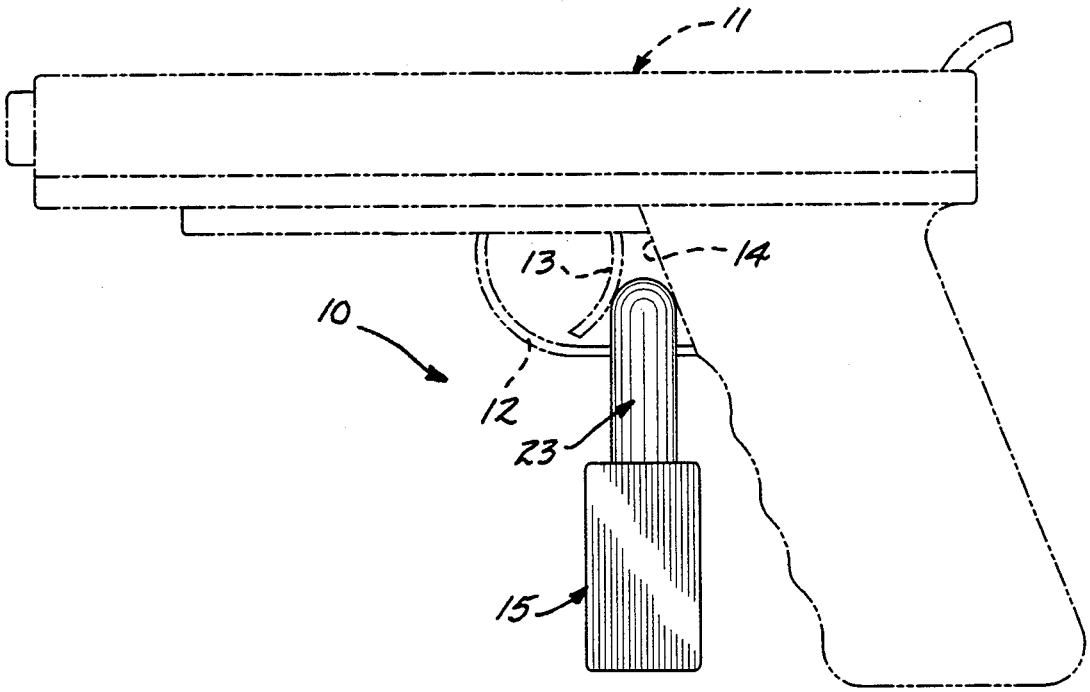
FIG. 1 is an orthographic side view of the invention in use.

With reference now to the drawings, and in particular to FIGS. 1 to 10 thereof, a new and improved trigger lock device embodying the principles and concepts of the present invention and generally designated by the reference numeral 10 will be described.

Figure 2:
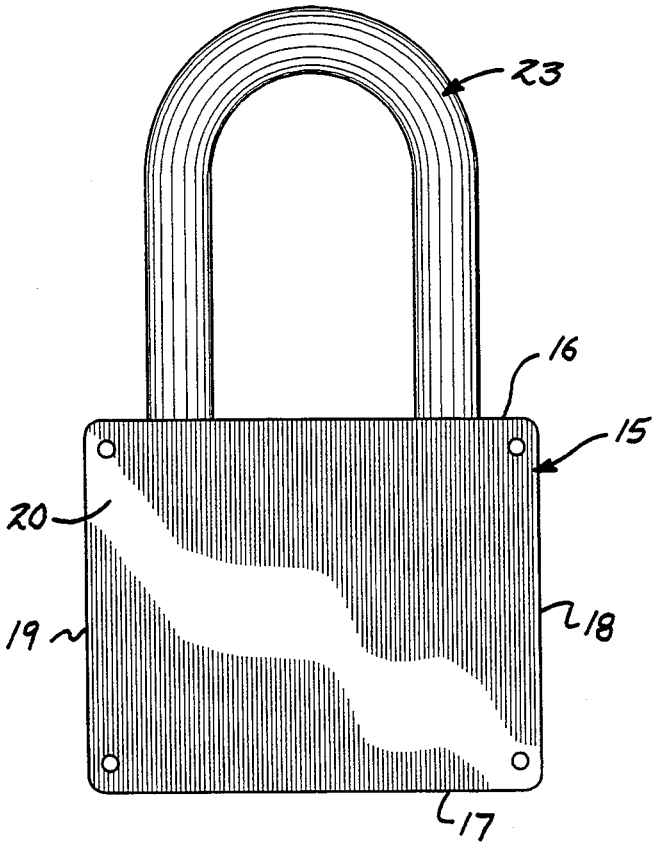
FIG. 2 is an orthographic frontal view of the lock structure taken in elevation.
Figure 3:
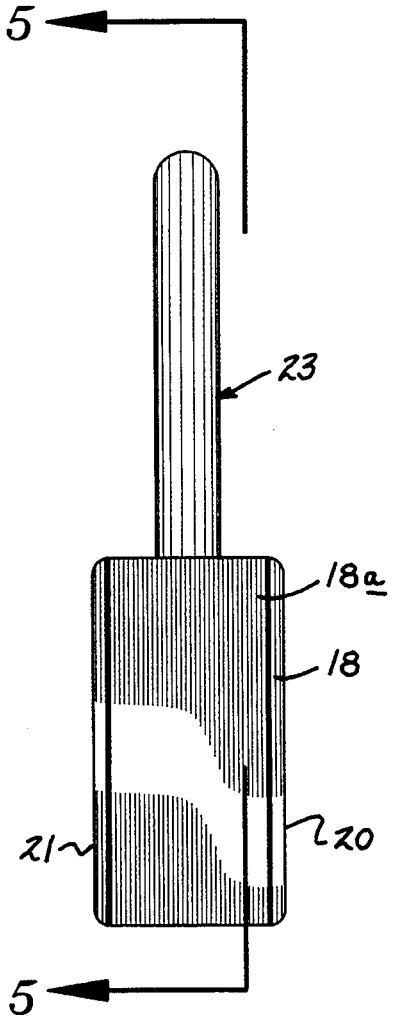
FIG. 3 is an orthographic end view of the lock structure.
Figure 4:
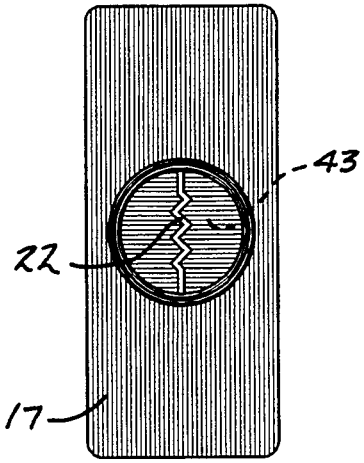
FIG. 4 is an orthographic bottom view of the lock structure.
Figure 5:
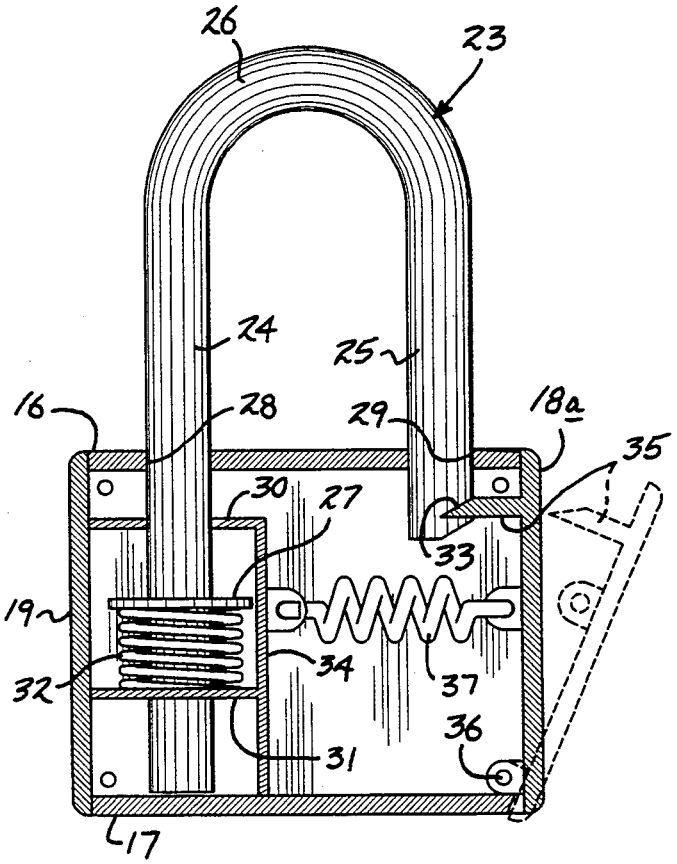
FIG. 5 is an orthographic view, taken along the lines 5—5 of FIG. 3 in the direction indicated by the arrows.

More specifically, the trigger lock device 10 of the instant invention essentially comprises cooperation with a firearm 11, having a trigger guard 12 mounting a trigger 13 pivotally therewithin, in a manner known in the prior art, with the trigger guard 12 mounted to the firearm frame 14. The lock housing 15 of the organization described herein includes a lock housing top wall 16 spaced from a lock housing bottom wall 17, a lock housing first side wall 18 spaced from a lock housing second side wall 19, and a lock housing front wall 20 spaced from a lock housing rear wall 21. As illustrated in the FIGS. 3 and 4 for example, a latch plate 18*a* is pivotally mounted to the bottom wall 17 about a hinge 36, with the latch plate positioned within the first side wall 18, such as indicated in FIG. 3. The lock housing bottom wall 17 is formed with a keyhole slot 22 which is of a non-operative type to provide for confusion to indicate conventional access into the housing by use of such a slot structure, when in fact such is not the case per the instant invention. A locking loop 23 is slidably directed through respective first and second openings 28 and 29 within the lock housing top wall. The locking loop includes respective first and second legs 24 and 25 having respective first and second links, with the first link greater than the second link, as illustrated in FIG. 5 for example, with the first and second legs slidably received through the respective first and second openings 28 and 29. A central U-shaped web 26 interconnects the first and second legs 24 and 25. The first leg 24 is arranged to include a first leg plate 27 positioned within the lock housing 15 as well as within an internal housing 30 positioned within the lock housing 15, as illustrated in FIG. 5. The internal housing includes an internal housing top wall 30 spaced from an internal housing bottom wall 31, that in turn is spaced above the lock housing bottom wall 17. The internal housing is further arranged with an internal housing side wall 34 spaced from the second side wall 19 and arranged in a facing relationship relative to the latch plate 18*a*. A first leg spring 32 is captured between the first leg plate 27 and the internal housing bottom wall 31. The latch plate 18*a* is arranged to include a projection 35 arranged for biased engagement with a second leg recess 33 when the second leg is directed into the lock housing 15 and the recess 33 aligned with the projection 35. A latch plate spring 37 is secured to the latch plate 18*a*, as well as to the internal housing side wall 34 to bias the latch plate into coplanar alignment with the first side wall 18, such as indicated in FIG. 2.

Figure 6:
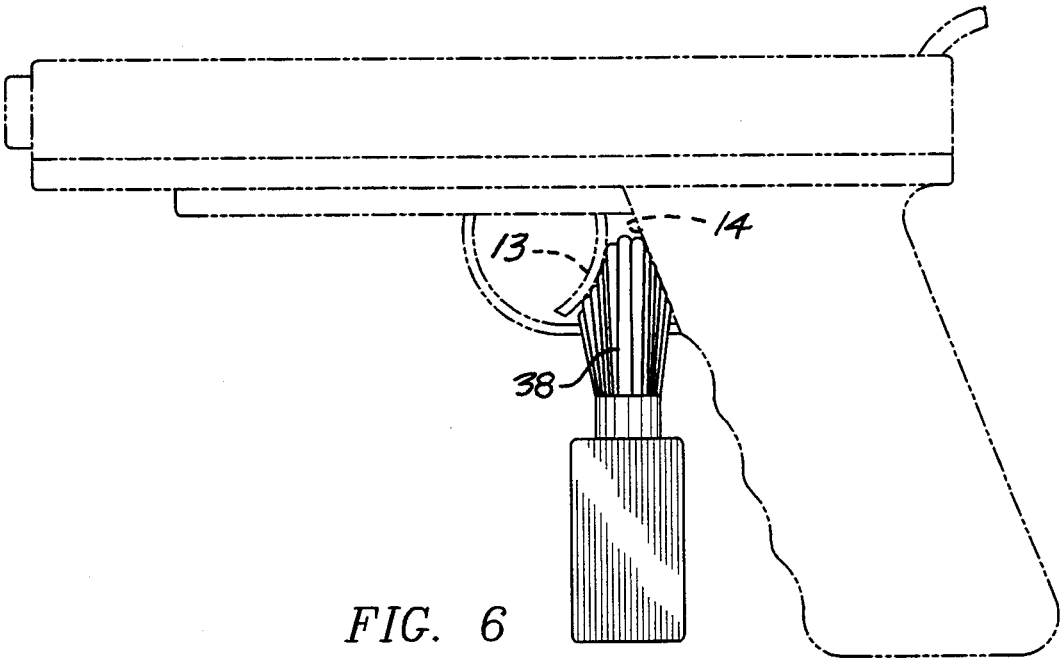
FIG. 6 is an orthographic side view of a modified locking loop structure employed by the invention.
Figure 7:
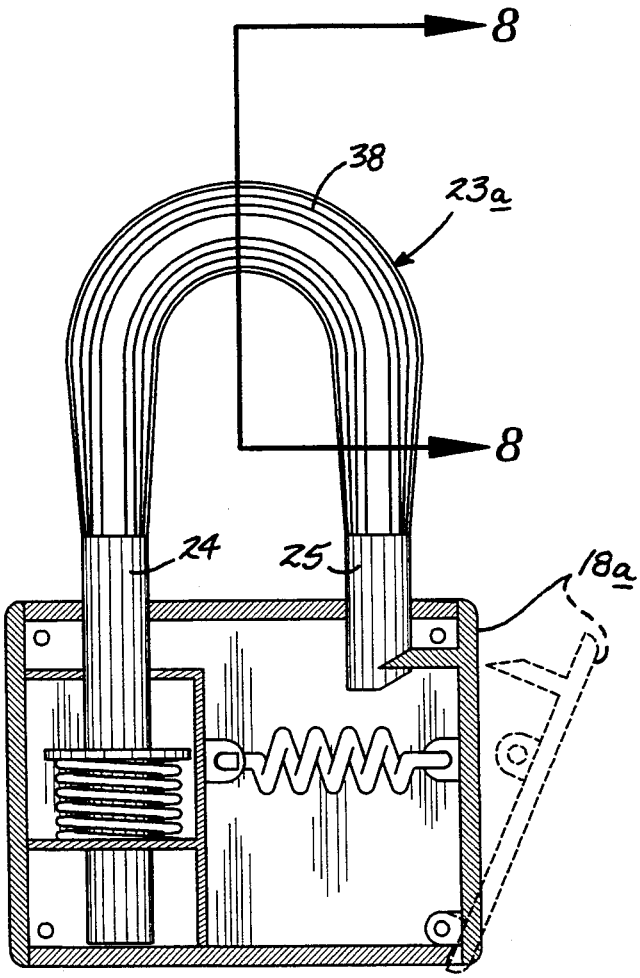
FIG. 7 is an orthographic cross-sectional illustration of the modified locking loop structure.
Figure 8:
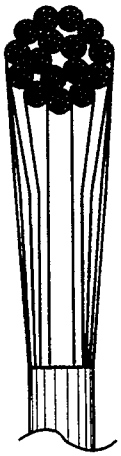
FIG. 8 is an orthographic view, taken along the lines 8—8 of FIG. 7 in the direction indicated by the arrows.

The FIGS. 6–8 indicate a modified locking loop 23*a*, having a plurality of elastomeric central web cables 38 extending and securing the first and second legs 24 and 25 together. The elastomeric central web 38 is compressible to provide its secure interfitting between the trigger 13 and the firearm frame 14. In this manner, relatively little spacing is availed for directing the trigger 13 against the frame to effect actuation of the associated firearm.

Figure 9:
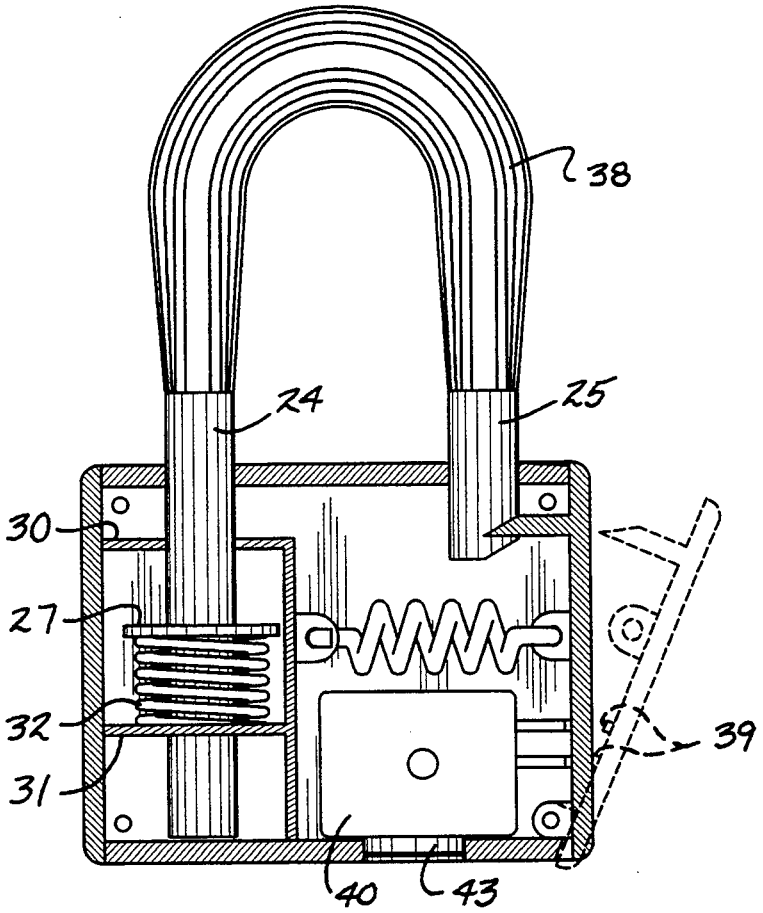
FIG. 9 is a modified aspect of the invention employing an alarm mechanism.
Figure 10:
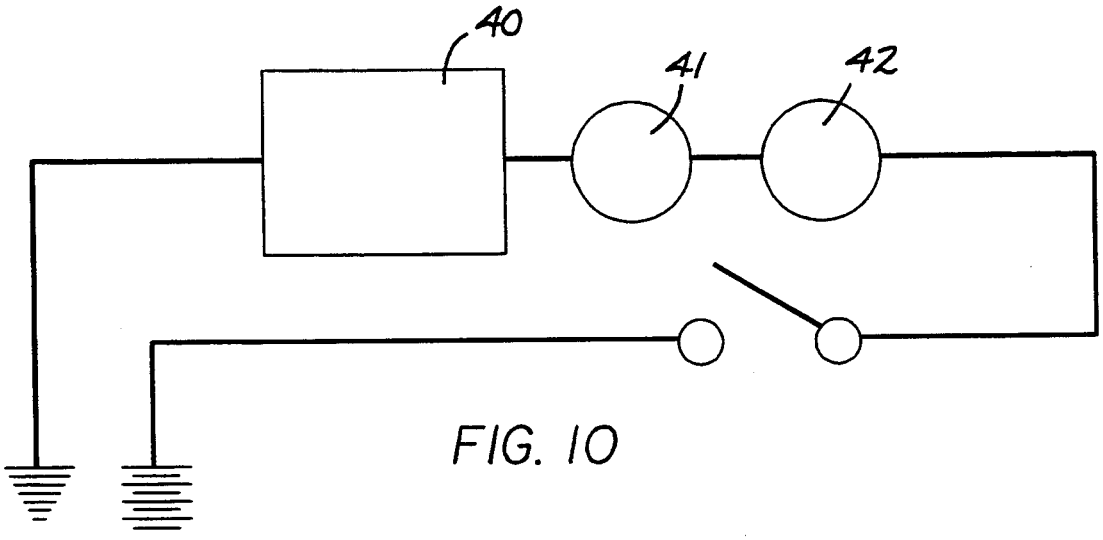
FIG. 10 is an electrical schematic illustration of the alarm mechanism construction.

The FIGS. 9 and 10 indicate the use of an alarm mechanism employed by the invention, wherein switch contacts 39 are mounted to the latch plate 18*a* for abutment with and to effect actuation of a motion detector 40 mounted within the lock housing 15 and between the internal housing and the latch plate. The motion detector includes a time delay 41 arranged for operative engagement with an audible alarm 42, with the audible alarm 42 having an audible alarm speaker 43 directed through the bottom wall typically in surrounding relationship relative to the keyhole slot 22, such as indicated by phantom line indication in FIG. 4.

In this manner, cooperation with the lock housing effecting its movement effects actuation of the audible alarm for further discouraging young children and the like from access to the associated firearm.

It should be noted that a battery "B" (44) is indicated in the FIG. 10, wherein any battery commercially available may be employed that will fit within the lock housing in cooperation with the motion detector, wherein typically the battery 44 may be incorporated within the motion detector housing structure should an insufficiently small battery be employed.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A trigger lock device arranged for securement to a firearm, the firearm having a trigger guard, with a firearm frame mounting said trigger guard, and a trigger pivotally mounted to the firearm frame within the trigger guard, wherein the device comprises, a lock housing, the lock housing including a lock housing top wall spaced from a lock housing bottom wall, a lock housing first side wall spaced from a locking housing second side wall, and a keyhole slot directed through the lock housing bottom wall, and a locking loop, the locking loop including a first leg spaced from and parallel a second leg, the first leg having a first length, the second leg having a second length, with the first length greater than the second length, and a U-shaped web connecting the first leg and the second leg, with the lock housing top wall including a first opening spaced from a second opening, with the first leg slidably received through the first opening, and the second leg slidably received through the second opening, with the lock housing first side wall including a latch plate, and a hinge mounted to the latch plate and to the bottom wall to pivotally mount the latch plate to the bottom wall, wherein the latch plate is displaced from a first position coplanar with the first side wall to a second position, wherein the latch plate is displaced relative to the first side wall, with an internal housing positioned within the lock housing, the internal housing including an internal housing top wall spaced from the lock housing top wall, an internal housing bottom wall spaced from the lock housing bottom wall, and an internal housing side wall positioned between the lock housing first side wall and the lock housing second side wall, and a latch plate spring mounted to the internal housing side wall and to the latch plate to bias the latch plate to the first position.

2. A device as set forth in claim 1 wherein the latch plate includes a latch plate projection and the second leg includes a second leg recess, wherein the second leg is arranged for alignment of the recess with the projection to receive the projection within the recess, and wherein the latch plate is arranged for displacing the projection from the recess in the second position.

3. A device as set forth in claim 2 wherein the first leg includes a first leg plate positioned between the internal housing top wall and the internal housing bottom wall, and a first leg spring captured between the first leg plate and the internal housing bottom wall to bias the first leg from the internal housing when the latch is in the second position.

4. A device as set forth in claim 3 including a motion detector mounted within the lock housing, with the motion detector including an audible alarm, the audible alarm including a speaker directed through the bottom wall in surrounding relationship relative to the keyhole slot, and the latch plate including a contact switch member, and the contact switch member is arranged for engagement with the motion detector when the latch plate is in the first position.

* * * * *